US005964426A

United States Patent [19]

Tabellini

[11] Patent Number: 5,964,426

[45] Date of Patent: Oct. 12, 1999

[54] ROLLER FOR REWINDING AND TENSIONING A FLEXIBLE ELEMENT SUCH AS A SHEET OF MATERIAL, SHUTTER OR SIMILAR, IN PARTICULAR FOR PROTECTIONS ON MACHINES

[75] Inventor: Giorgio Tabellini, Bologna, Italy

[73] Assignee: P.E.I. PROTEZIONI ELABORAZIONI INDUSTRIAL S.r.l., Calderada di Reno, Italy

[21] Appl. No.: 08/896,706

[22] Filed: Jul. 18, 1997

[30] Foreign Application Priority Data

Jul. 23, 1996 [EP] European Pat. Off. ..... 96830405

[51] Int. Cl.[6] ..... B65H 75/48; E06B 9/56

[52] U.S. Cl. ..... 242/372; 242/375; 160/318; 160/316

[58] Field of Search ..... 242/372, 375, 242/375.3; 160/318, 313, 315, 316, 317, 245

[56] References Cited

U.S. PATENT DOCUMENTS

| | | | |
|---|---|---|---|
| 449,538 | 3/1891 | Johnson | 160/316 |
| 748,641 | 1/1904 | Newell | 160/317 |
| 1,240,579 | 9/1917 | Kirsch | 160/318 |
| 1,593,324 | 7/1926 | Anderson | 160/318 |
| 2,505,418 | 4/1950 | Martin | 242/375 |
| 2,587,652 | 3/1952 | Rostine | 242/375 |
| 5,078,198 | 1/1992 | Tedeschi | 160/315 |

FOREIGN PATENT DOCUMENTS

| | | | |
|---|---|---|---|
| 250577 | 1/1964 | Australia | 160/318 |
| 42 11 940 A1 | 10/1993 | Germany . | |

*Primary Examiner*—John M. Jillions
*Attorney, Agent, or Firm*—Nicholas A. Kees; Godfrey & Kahn, S.C.

[57] ABSTRACT

A roller for rewinding and tensioning a flexible element, the element having a greater length than width, includes a tubular body to which one end of the flexible element is fixed; a shaft positioned so that it is coaxial to the tubular body, the two being attached in such a way that they may rotate relative to one another about a shared axis; at least one helical spring driving element made of wire, housed in the tubular body, the ends of the spring being connected, by means of support and connecting parts, to the shaft and the tubular body so as to contrast the reciprocal rotation in the direction of unwinding of the flexible element, at least one of the support and connecting parts being able to slide along the axis of the roller on relative guides so as to position itself along the shaft, adapting each time to the variations in the axial length of the spring driving element, the variations being caused by the unwinding and rewinding of the flexible element on the roller.

14 Claims, 3 Drawing Sheets

ROLLER FOR REWINDING AND TENSIONING A FLEXIBLE ELEMENT SUCH AS A SHEET OF MATERIAL, SHUTTER OR SIMILAR, IN PARTICULAR FOR PROTECTIONS ON MACHINES

BACKGROUND OF THE INVENTION

The present invention relates to a roller for rewinding and tensioning a flexible element, with greater length than width, for example a flexible sheet of material or a shutter or rolling shutter with jointed elements. The invention applies in particular, but without thereby restricting the scope of the disclosure, to the field of industrial protections, to the manufacture of rolling screens or guards (for example, those used to isolate machine tools) or to protect and guard certain machine parts such as slideways. Protections of this kind have flexible elements which roll up onto rollers and which can be unrolled to prevent machine parts not only from knocking against extraneous objects or coming into contact with shavings or swarf but also from being dirtied by contact with acids or pollutants in general. Similar protection devices may also be used as movable covers, strong enough to be walked on, if necessary, placed over the installation pits of large machines or as rolling covers for tanks.

A roller of the type described above is the object of U.S. Pat. No. 5,775,619, issued to the Applicant, the disclosure of which is hereby incorporated by reference.

Similar rollers substantially consist of a tubular body, sealed at the ends by two flanges which are axially drilled to allow the passage of the ends of a support shaft which lies coaxial to the roller. One end of the flexible element is fixed to the external surface of the tubular body.

The flanges and the shaft are connected in such a way that they can turn, and can rotate relative to one another about a shared axis. Moreover, the tubular body and shaft are rigidly fixed to opposite ends of a helical wire spring, which is housed inside the tubular body. The connection at the ends of the spring is made using support and connecting parts which have the shape of a cylindrical pad, inserted axially into the spring and screwed onto the coils at the end sections of the spring, by means of surfaces with suitable matching grooves. The connecting parts are then rigidly fixed, one to the shaft, and the other to the tubular body. When the flexible element is pulled, so as to unroll it from the roller, the spring or springs are subjected to a torsion which causes elastic energy to accumulate in the springs. The said energy is then returned in the form of a force couple which, forcing the roller to rotate in the opposite direction, allow the rewinding and relative tensioning of the flexible element about the tubular body.

A specific problem with such rollers is related to the fact that, in most applications, the length of the flexible elements is usually much greater than the width.

As a result, the rollers have relatively small axial dimensions and, when used, are subjected to a high number of rotations about their axes in order to wind and unwind the flexible element. This means that the axial length of the springs used for this purpose is considerable, so that the said springs are often too long to be housed in the tubular body.

A solution to this problem which allows a compromise between the overall dimensions of the roller and the generation of elastic forces of suitable intensity for rewinding the flexible element, was obtained by fitting two or more springs, positioned coaxial to one another, inside the tubular body. However, this solution, which proved satisfactory in some applications, remained problematic in other cases. In fact, it must be noticed that when the flexible element is unwound, for each turn of the roller relative to the shaft, a length of wire substantially corresponding to the length of a coil is unwound from the spring, so that the axial dimension of the spring increases by one coil. As a result, for each turn of the roller relative to the shaft, with equal torque applied to the spring, the diameter of the spring is reduced and the spring contracts towards the axis of the shaft. Therefore, when fitting the spring or springs to the roller, it is necessary to fix the ends of the springs at a distance greater than the largest axial dimension that they occupy when wound down, so as to ensure that the coils are separated by a given distance.

The gap created between one coil and the next must be such that, when the spring is loaded, following unwinding of the flexible element from the roller, the spring can extend freely and, at its maximum load, reach a compact configuration in which all of the coils make contact with one another. During the assembly stage, it is, therefore, necessary to consider the presumable number of turns envisaged for each roller, then fit the springs with the coils spaced sufficiently.

The afore-mentioned assembly method has several disadvantages, mainly due to the fact that during rotation of the roller relative to the shaft and the consequent loading of the spring, the latter takes on an irregular shape about its own axis, shifting from one place to another inside the roller and hitting against the internal surface of the roller. This leads to the creation of points of wear on the spring which are not uniform and an abnormal deformation of its wire.

Moreover, the afore-mentioned configuration, especially where two or more springs are fitted coaxially, implicates the possibility of the coils of two springs interfering with one another or becoming entwined. The aim of the present invention is to eliminate the afore-mentioned technical disadvantages.

SUMMARY OF THE INVENTION

According to the present invention, a roller is supplied for rewinding and tensioning a flexible element such as a sheet of material, a shutter or similar, in particular for protections on machines, said flexible element having greater length than width, and the roller including a tubular body, to the external surface of which one end of the flexible element is fixed, a pair of flanges for sealing the ends of the tubular body, a shaft fitted coaxial to the tubular body and through the relative flanges, to which it is connected in such a way that it can rotate freely, said tubular body and shaft turning freely relative to one another about a shared axis; at least one driving element, consisting of a helical wire spring housed in the tubular body, the ends of the spring being connected to the shaft and the tubular body, so as to contrast the relative rotation created by unwinding the flexible element from the roller; parts which support and connect the ends of the said spring driving element, connected to the shaft and the tubular body, said support and connecting parts having fixing surfaces, each of the said surfaces bearing grooves to house the wire with which they engage to fix the support and connecting parts to the ends of the said spring driving element, said support and connecting parts being securely fixed to the shaft and to the tubular body as it rotates about its axis, characterised in that at least one of the support and connecting parts can move longitudinally relative to the shaft, along the axis of rotation of the roller, on relative guides which are positioned and shaped so as to allow the said support and connecting part which moves along the axis of rotation of the roller to position itself along the shaft, adapting each time to the variations in the axial length of the said spring driving element, these variations being determined by the unwinding and rewinding of the flexible element on the roller; means which transmit the rotation, which operate between the said body and the support and connecting part which moves axially to the shaft.

BRIEF DESCRIPTION OF THE DRAWINGS

Further characteristics and advantages of the invention are apparent from the detailed description which follows, with reference to the accompanying drawings, which illustrate preferred embodiments of the invention in which.

DESCRIPTION OF THE PREFERRED EMBODIMENTS

Figure 1:
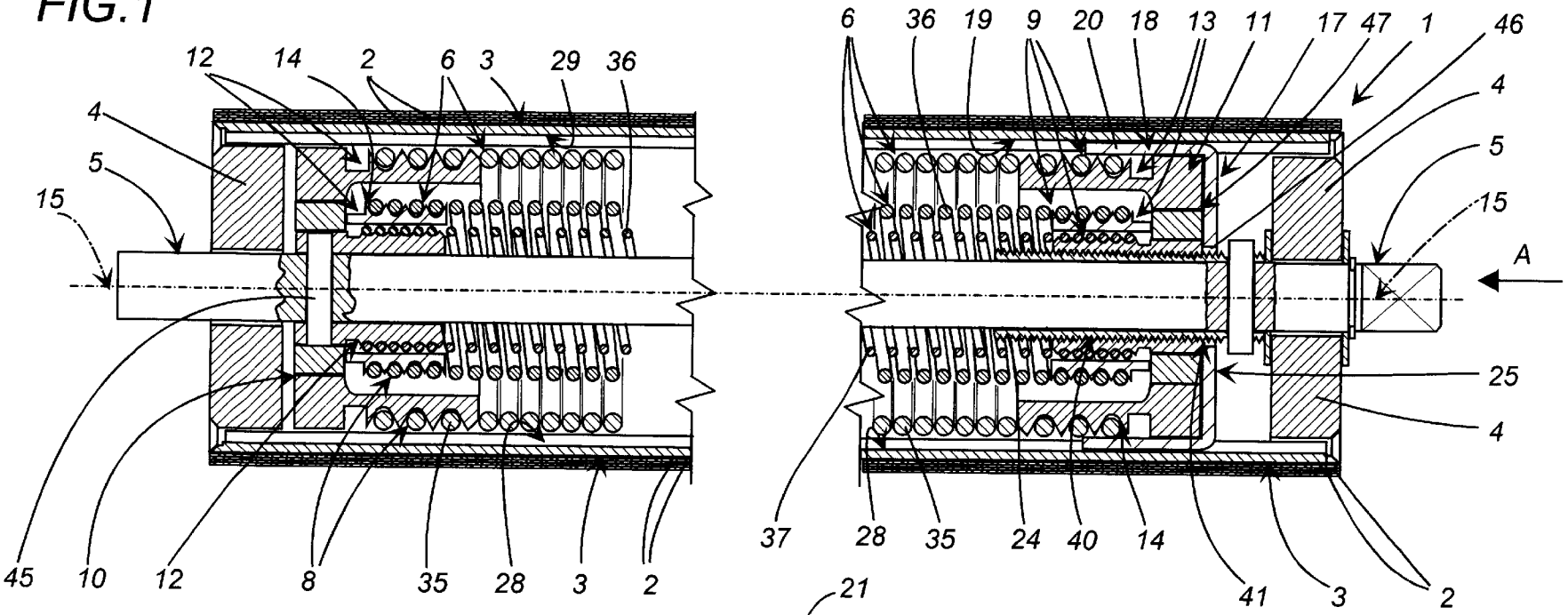
FIG. 1 is an axial cross-section of a first embodiment of the roller disclosed, represented as a whole.

With reference to the drawings listed above, the numeral 1 indicates as a whole a roller for rewinding and tensioning a flexible element 2, said flexible element having a greater length than width, being, for example, a band, sheet of material, or even a rolling shutter consisting of jointed panel strips.

The roller 1 basically consists of a tubular body 3, to the external surface of which one end 50 of the flexible element 2 is fixed, of two flanges 4 which seal the ends of the tubular body 3 and of a shaft 5, fitted coaxial to the tubular body 3 and passing through the flanges 4.

The shaft 5 and the flanges 4 are connected in such a way that they can turn, so as to allow them to rotate relative to one another about the axis 15 of the roller 1.

Figure 3:
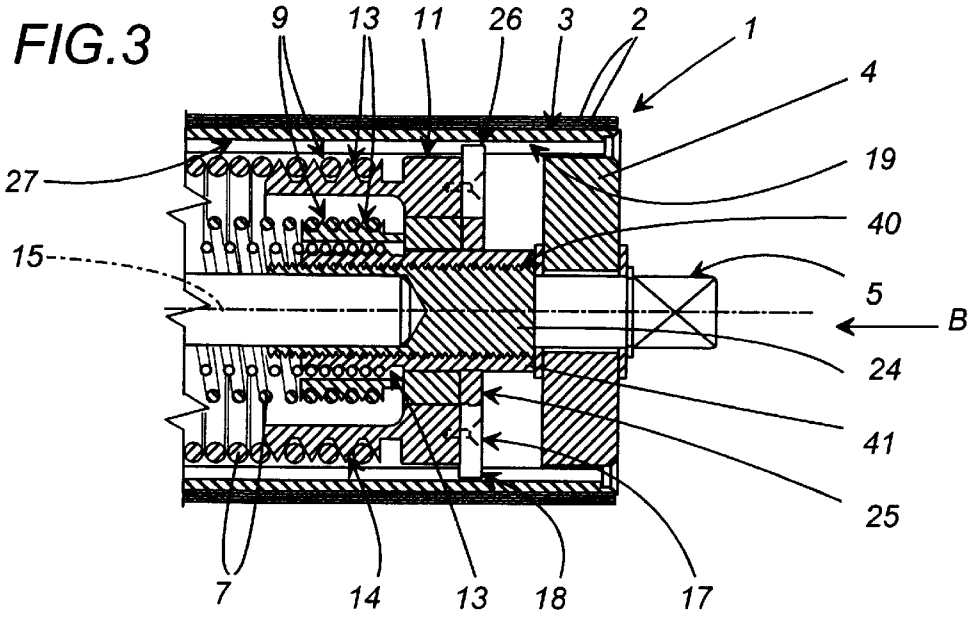
FIG. 3 is an axial cross-section of a second embodiment of the roller disclosed, represented as a whole.

FIGS. 1 and 3 show that the tubular body 3 of the roller 1 houses three helical springs 35, 36 and 37 made of wire 7, said springs being coaxial to one another, fitted one inside the other, and forming a driving element 6 which accumulates energy. The springs 35, 36 and 37 are fitted with their coils compacted, that is to say, in close contact with one another, and their ends 8 and 9 are connected to the tubular body 3 and the shaft 5 so that they contrast the relative rotation in the direction of unwinding of the flexible element 2 from the roller 1.

In particular, this connection is made using a pair of support and connecting parts 10, 11 which are fitted between the shaft 5, the tubular body 3 and the ends 8, 9 of the springs 35, 36 and 37.

The support and connecting parts 10, 11 have the shape of a cylindrical pad, the exterior of which has respective fixing surfaces 12 and 13 bearing helical grooves 14 whose shape matches that of the wire 7. The connection to the ends 8,9 of the springs 35, 36 and 37, is made by inserting the walls 12 and 13 of the support and connecting parts 10, 11 axially into the springs, then screwing them together tightly with the relative support and connecting parts 10, 11. One of the support and connecting parts 10, 11, in particular 10, is attached to the shaft 5 by a pin 45, while the other, labelled 11, is attached to the tubular body 3, so that they are securely fixed to them relative to the rotation about the axis 15 of the roller 1. As regards the relative freedom of movement along the axis 15, only one of the support and connecting parts, more precisely that labelled 10, is fixed in a stable, preset position; the other, labelled 11, is fitted so that it may slide along the axis of rotation 15 of the roller 1 on relative guides 17, 18, 19, 22, 23, so that during unwinding or rewinding of the flexible element 2, each of the springs 34, 35, 36 can freely vary its axial length, since the support and connecting part 11, being free to position itself along the shaft 5, adapts each time to the variations in the axial length of the springs.

Figure 2:
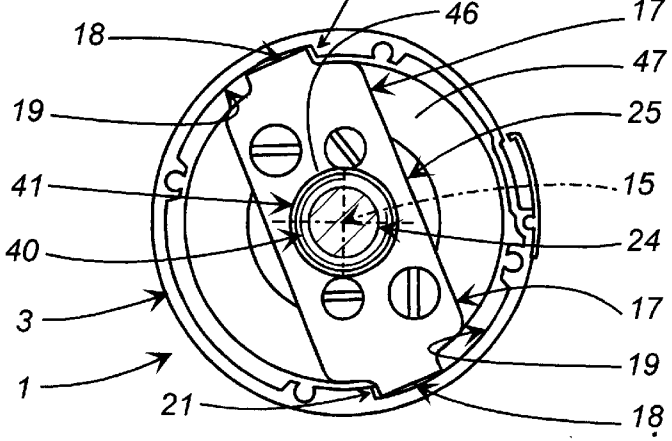
FIG. 2 is a side view seen from A, with some parts cut away and some parts in cross-section to better illustrate others, of the roller in FIG. 1.

In a first embodiment of the roller 1, illustrated in FIGS. 1 and 2, the support and connecting part 11 is attached to the tubular body 3 in such a way that when the roller 1 rotates, the support and connecting part 11 also rotates. The support and connecting part 11 has a threaded bushing 41, through which it is fitted on an externally threaded sleeve 24, which is securely fixed to the shaft 5.

This type of connection allows the support and connecting part 11 to turn about the axis 15 securely fixed to the tubular body 3, at the same time allowing it to slide along the axis 15 of the roller 1, screwing itself onto or unscrewing itself from the sleeve 24 and so moving towards or away from the other support and connecting part 10.

In such an embodiment, the guides include a plate 25 which is fixed to the rear wall 47 of the support and connecting part 11, and has two arms 17 which extend radially from the shaft 5. The ends of the arms 17 are fitted with two end shoes 18, set opposite one another and offset by 180° about the axis 15 of the roller 1. The shoes 18 slide in matching grooves 19, parallel with the axis 15, said grooves made inside the tubular body 3, on its internal surface 28.

As regards the shoes 18, FIG. 1 in particular reveals that they form a single body together with the arms 17 and are actuated by a protrusion 20, bent at 90° on the arm 17, said protrusion projecting towards the inside of the roller 1 above the fixing surface 13 of the support and connecting part 11. The protrusion 20 makes contact with the wire 7 of the spring 35 from a position opposite the groove 14 which houses it, in this way contributing both to the effectiveness of the connection between the spring 35 and support and connecting part 11, and the regularity of winding and unwinding of the coils during operation of the roller 1.

As for the grooves 19, FIG. 2 shows that the said grooves 19 are made in the internal surface 28 of the tubular body 3, evenly distributed about the axis 15 of the roller 1. Moreover, their profiles are shaped in such a way that, if two grooves 19 located in diametrically opposed positions relative to the axis 15 of the roller are observed, their profiles appear to be identically shaped, but inverted, creating an anti-symmetrical configuration. Such a configuration allows precision fitting of the protrusions 20 in the grooves 19, thus causing less wear, and evenly distributing it over the two shoes 18. FIG. 2 also shows that the length of the grooves 19 around the tubular body 3, is noticeably greater than the corresponding length of the shoe 18. This facilitates not only their fitting during assembly of the roller 1, but also the setting of the desired preloading value for the springs.

Another embodiment of the groove 19 may be obtained by giving the tubular body 3 a cylindrical internal shape in which there is at least one flat face 21, positioned and oriented so as to match the shape of the shoe 18. Obviously, it is also possible to envisage a plurality of such faces 21 which, being inside the tubular body 3 and distributed about the axis 15, may give the tubular body 3 a number of differently shaped polygonal profiles.

Figure 4:
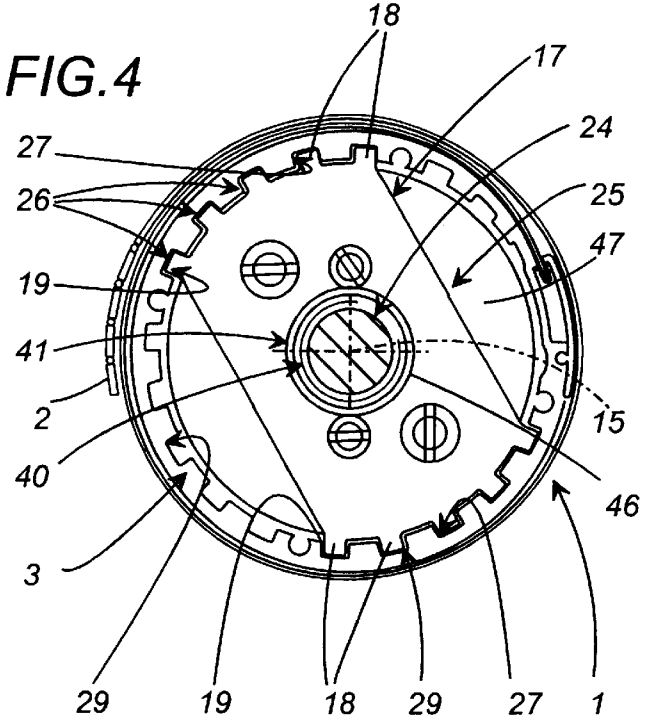
FIG. 4 is a side view seen from B, with some parts cut away and some parts in cross-section to better illustrate others, of the roller in FIG. 3.

In the embodiment illustrated in FIGS. 3 and 4 the guides consist of a splined section 26, made on the free end of each arm 17 of the plate 25. The splined section 26 defines a plurality of shoes 18, designed to attach themselves in such a way that they can slide relative to the axis of rotation 15 of the roller 1, to a corresponding matching splined surface 27 which, in turn, is made directly on the internal surface 28 of the tubular body 3 and has as many seats 29 as there are shoes 18 to be housed.

In both of the afore-mentioned embodiments, the guides labelled 17, 18 and 19 also constitute means for the transmission of the rotation between the said body 3 and the support and connecting part 11.

Figure 5:
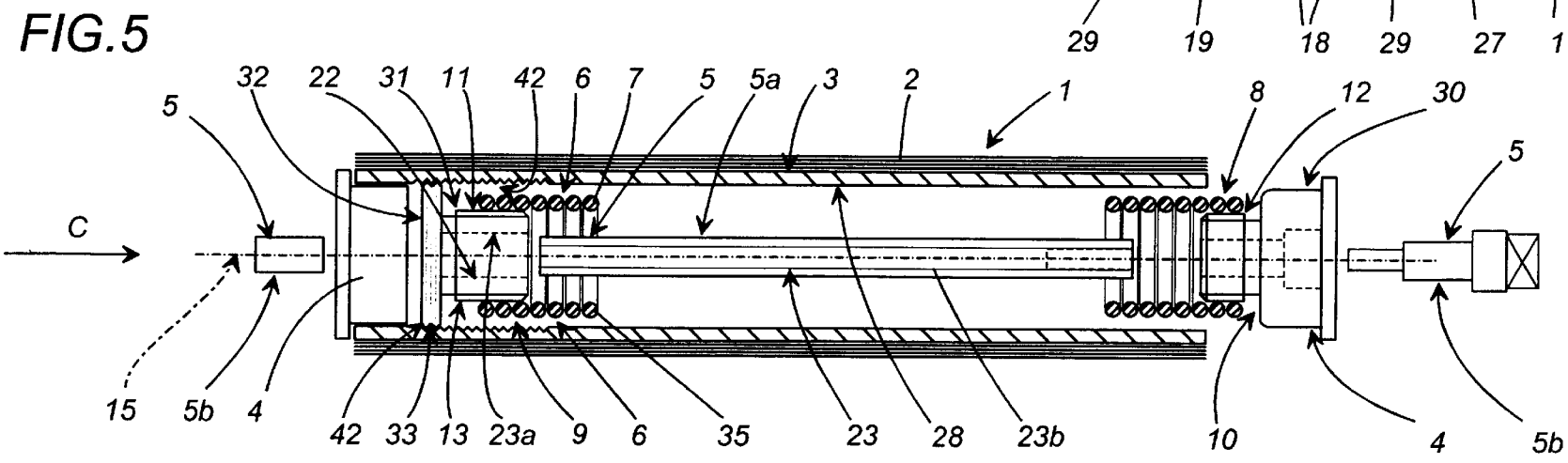
FIG. 5 is a schematic axial cross-section of a third embodiment of the roller disclosed.
Figure 6:
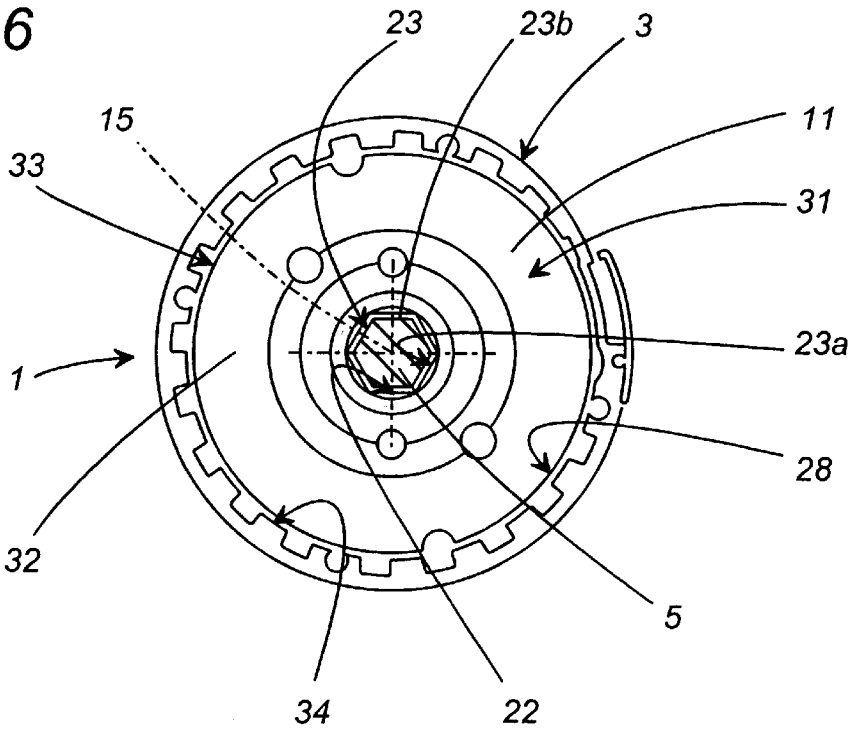
FIG. 6 is a side view seen from C, with some parts cut away and some parts in cross-section to better illustrate others, of the roller in FIG. 5.
Figure 7:
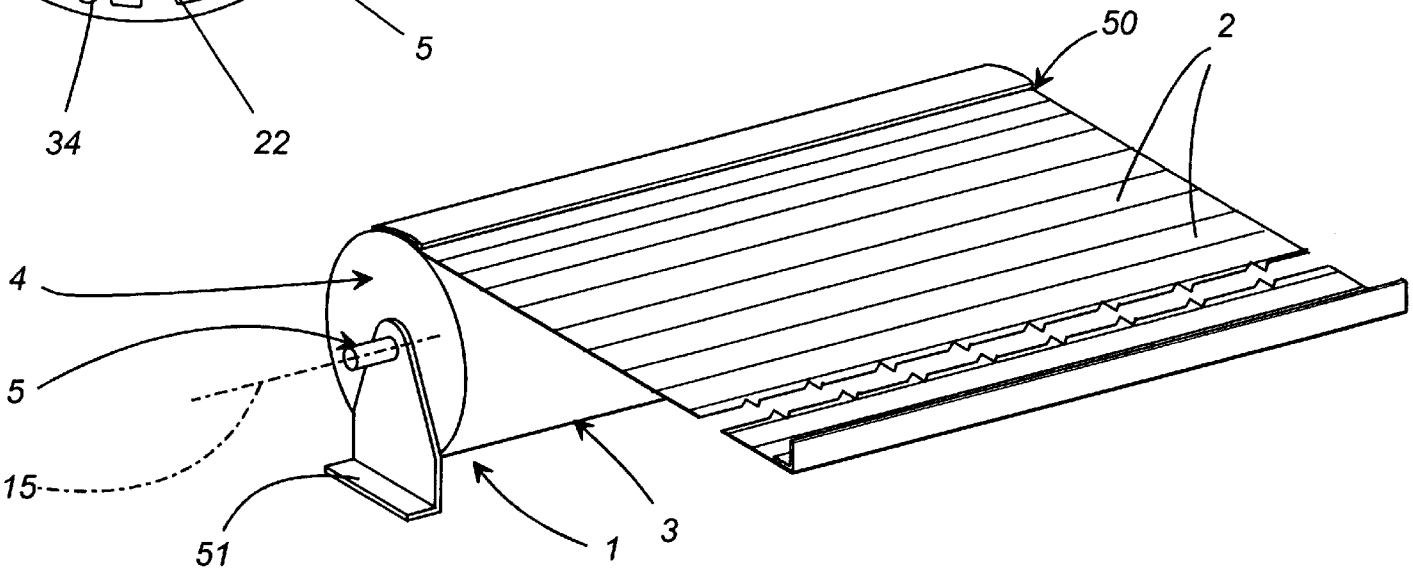
FIG. 7 is a perspective schematic view of a roller according to the present invention, supported by a pair of brackets 51.

A further embodiment of the roller 1 according to the present invention is illustrated in FIGS. 5 and 6. In this embodiment, the guides are located directly on the shaft 5, rather than on the tubular body 3.

In such case, an embodiment of the guides, illustrated in FIG. 6, may be obtained by means of a prismatic coupling with a splined section between the shaft 5 and a hole 22 for the coaxial connection of the support and connecting part 11, which must be free to move axially along the shaft 5. This may be obtained by making one or more flat faces 23*b*, oriented parallel to the axis 15 of the roller 1 on the external surface of the shaft 5, and by making one or more matching shaped faces 23*a* in the hole 22 which connects the support and connecting part 11 to the shaft 5.

More specifically, with reference to FIG. 5, the shaft 5 consists of a central portion 5*a* with splined section, having flat faces 23*b*, and two smooth end portions 5*b*, upon which the flanges 4 can rotate. The support and connecting part 11 slides along the central portion 5*a* of the shaft 5.

In the embodiment shown in FIG. 5, the means for transmission of the rotation between the tubular body 3 and support and connecting part 11 which moves axially along the shaft 5, consist of a connecting cover 30 consisting of the support and connecting part 10 which turns freely relative to the shaft 5 and is rigidly fixed to one of the two flanges 4. The part 10 is connected by the spring 35 to the corresponding support and connecting part 11 which moves axially relative to the shaft 5. FIG. 5 shows only one spring 35, which forms the spring driving element 6, although it is obvious that even in this particular case, there may be two or more springs, coaxially fitted one inside the other.

Similarly to the embodiments illustrated in FIGS. 1 to 4, the support and connecting part illustrated in FIG. 5 has its own means 32, 33, 34 for axial movement which are positioned and operate between the said mobile support and connecting part 11 and the said tubular body 3. Following rotation of the tubular body 3, the said means cause a corresponding given axial translation of the mobile support and connecting part 11, relative to the shaft 5 and along the axis 15. In particular, the means for axial movement consist of a ring-shaped element 32, fitted on the support and connecting part 11 which moves axially relative to the shaft 5, the dimensions of its external diameter matching the dimensions of the internal diameter of the tubular body 3. The perimeter of the ring-shaped element 32 has a threaded zone 33 which connects with a corresponding threaded portion 34 of the internal surface 28 of the tubular body 3. In this way, the rotation of the tubular body 3 causes a corresponding translation of the support and connecting part 11 along the axis 15 of the shaft 5.

At this point, it is necessary to specify certain information relative to the threading 40 between the bushing 41 and sleeve 24, and the threading 42 between the zone 33 of the ring-shaped element 32 and the portion 34 of the internal surface 28 of the tubular body 3. Both sets of threading 40 and 42 may have a pitch which is equal to or greater than the diameter of the wire 7 of the springs 35, 36 and 37. In particular, in the case of the spring 35, the outermost one, the diameter of the wire 7 is equal to the pitch of the threading 40 and 42, so that the movement of the part 11 on the shaft 5 and the variation of the free longitudinal dimension of the spring 35 itself coincide perfectly, the spring remaining in its compact configuration, that is to say, with the coils closely packed together, irrespective of the rotation of the roller 1. In the case of the inner springs 36, 37, normally selected with a wire 7 whose diameter is smaller than the pitch of the threading 40 and 42, for each rotation of the roller when the flexible element 2 is unwound, the springs 36 and 37 tend to open slightly, so that a small gap is created between the coils, a gap which disappears again when the flexible element 2 is rewound onto the roller 1, so that the spring returns to its compact condition. Obviously, the size of the wire 7 and the pitch of the threading 40 and 42 are selected each time so as to avoid any possible interference between the closely positioned springs.

To limit the friction which causes wear on contact surfaces, it is possible to improve the guides by envisaging their separation by revolving bodies which, in the first embodiment of the guides are positioned between the shoes 18 and grooves 19 made in the tubular body 3, hole 22 and shaft 5.

The wear between elements which actuate the guides could equally be reduced by the insertion of a fluid, even under pressure.

A possible improvement of the invention, to avoid wear on the springs which may be caused by their impact with projections from the internal surface 28 of the tubular body 3, is to ensure that the latter has a splined surface 27 all the way around its circumference.

The above description clearly indicates that the solution adopted allows the problem-free coaxial assembly, even of a number of springs significantly greater than two, without the possibility of the springs interfering with one another, since each behaves like a tube.

Moreover, given that all of the coils substantially remain in close contact with one another, during operation of the roller the springs do not take on an irregular shape about their axes, and the wear is evenly distributed along the entire length of the wire, this being an advantage, since the spring lasts much longer and operates in a regular fashion even as the cross-section of the wire is gradually reduced.

Given that the configuration of the axis of the spring remains permanently straight, the springs can be fitted at a lesser radial distance from one another than in the known solutions. All other conditions being the same, this, therefore, allows less problematic fitting of the springs inside the tubular body, and a reduction of the diameter of the roller compared to the known solutions for similar applications.

The present invention may be subject to numerous modifications and variations, all of which are encompassed by the design concept. Moreover, all elements may be substituted with technically equivalent parts.

What is claimed:

1. A roller for rewinding and tensioning a flexible element such as a sheet of material, a shutter or similar, in particular for protections on machines, said flexible element having greater length than width, and the roller including:

a tubular body, to the external surface of which one end of the flexible element is fixed, a pair of flanges which seal the ends of the tubular body, a shaft fitted coaxially to the tubular body and passing through the pair of flanges in such a way that the shaft can rotate freely said tubular body and shaft being free to rotate relative to one another about a shared axis;

at least one helical spring driving element made of wire, housed within the tubular body, the respective ends of the spring driving element being attached respectively to the shaft and to the tubular body so as to oppose rotation in the direction of unwinding of the flexible element from the roller;

support and connecting parts for the ends of the spring driving element, being connected respectively to the shaft and to the tubular body, said support and connecting parts having respective fixing surfaces, each having grooves for fixing the support and connecting parts respectively to the ends of the spring driving element, said support and connecting parts being securely fixed respectively to the shaft and the tubular body as it rotates about the axis;

wherein at least one of the support and connecting parts is free to move longitudinally relative to the shaft, along the axis of rotation of the roller, by means of guides, the guides being positioned and shaped so as to allow the support and connecting part which moves along the axis of rotation of the roller to position itself along the shaft, in response to variations in the axial length of the spring driving element, said variations being caused by the unwinding and rewinding of the flexible element on the roller; and means for transmitting rotation, operating between the tubular body and the support and connecting part which moves axially relative to the shaft;

the means for transmitting rotation comprising at least one radial arm, the arm having at least one end shoe and mounted radial to the roller by one of the support and connecting parts, and a groove made in the tubular body longitudinal to the axis, the shoe sliding within the groove;

the radial arm being part of a plate having at least two arms, the end of each arm bearing a shoe fitted so that it is offset about the axis, said shoes fitting into two matching grooves on the tubular body;

said shoe or shoes forming a single body together with the radial arm, and including a protrusion which is bent longitudinally to the internal surface of the tubular body;

the protrusion being bent in such a way that it projects above the fixing surface of the corresponding connecting part so that it makes contact with the spring opposite the groove in which the spring is placed.

2. A roller for rewinding and tensioning a flexible element such as a sheet of material, a shutter or similar, in particular for protections on machines, said flexible element having greater length than width, and the roller including a tubular body, to the external surface of which one end of the flexible element is fixed;

a pair of flanges which seal the ends of the tubular body;

a shaft fitted coaxially to the tubular body and passing through the pair of flanges in such a way that the shaft can rotate freely, said tubular body and shaft being free to rotate relative to one another about a shared axis;

at least one helical spring, driving element made of wire, housed within the tubular body, the ends of the spring driving element being attached to the shaft and to the tubular body so as to oppose rotation in the direction of unwinding of the flexible element from the roller;

support and connecting parts for the ends of the spring driving element, connected respectively to the shaft and to the tubular body, said support and connecting parts having respective fixing surfaces, each having grooves for fixing the support and connecting parts respectively to the ends of the spring driving element, said support and connecting parts being securely fixed respectively to the shaft and the tubular body as it rotates about the axis, wherein at least one of the support and connecting parts is free to move longitudinally relative to the shaft, along the axis of rotation of the roller, by means of guides, the guides being positioned and shaped so as to allow the support and connecting part which moves along the axis of rotation of the roller to position itself along the shaft, in response to variations in the axial length of the spring driving element, said variations being caused by the unwinding and rewinding of the flexible element on the roller;

means for transmitting rotation, operating between the tubular body and the support and connecting part which moves axially relative to the shaft; and the guides including at least one flat face, parallel with the axis inside an axial hole in one of the support and connecting parts which moves axially to the shaft, said flat face being attached to a matching face on the shaft, to prevent reciprocal rotation between the support and connecting parts and the shaft.

3. The roller according to claim 2, wherein the hole and shaft have a plurality of flat faces, creating a prismatic coupling between the mobile support and connecting parts and the shaft.

4. A roller for rewinding and tensioning a flexible element such as a sheet of material, a shutter or similar, in particular for protections on machines, said flexible element having greater length than width, and the roller including:

a tubular body, to the external surface of which one end of the flexible element is fixed;

a pair of flanges which seal the ends of the tubular body, a shaft fitted coaxially to the tubular body and passing through the pair of flanges in such a way that the shaft can rotate freely, said tubular body and shaft being free to rotate relative to one another about a shared axis;

at least one helical spring driving element made of wire, housed within the tubular body, the ends of the spring driving element being attached to the shaft and to the tubular body so as to oppose rotation in the direction of unwinding of the flexible element from the roller;

support and connecting parts for the ends of the spring driving element, connected respectively to the shaft and to the tubular body, said support and connecting parts having respective fixing surfaces, including grooves for fixing the support and connecting parts respectively to the ends of the spring driving element, said support and connecting parts being securely fixed respectively to the shaft and the tubular body as it rotates about the axis, wherein at least one of the support and connecting parts is free to move longitudinally relative to the shaft, along the axis of rotation of the roller, by means of guides, the guides being positioned and shaped so as to allow the support and connecting part which moves along the axis of rotation of the roller to position itself alone the shaft, in response to variations in the axial length of the spring driving element, said variations being caused by the unwinding and rewinding of the flexible element on the roller;

means for transmitting rotation, operating between the tubular body and the support and connecting part which moves axially relative to the shaft; and the guides including at least one flat face, said face being made parallel with the axis inside an axial hole in one of the support and connecting parts which moves axially to the shaft, said flat face being attached to a matching face on the shaft in such a way that the hole and shaft form a prismatic coupling between the mobile support and connecting part and the shaft; said means for transmitting rotation including a connecting cover, in turn including one of the support and connecting parts which is free to rotate relative to the shaft, being rigidly fixed to one of the two flanges and connected by the spring driving element to the corresponding support and connecting part which moves axially to the shaft although being unable to rotate relative to the shaft.

5. The roller as described in claim 4, wherein it includes a means for axial movement, said means being positioned and operating between the mobile support and connecting part and the tubular body, the means being designed in such a way that, following rotation of the tubular body, they cause a given corresponding axial translation of the mobile support and connecting part, relative to the shaft and along the axis.

6. The roller according to claim 5, wherein the means for axial movement includes a ring-shaped element, said element being positioned on the support and connecting part which moves axially to the shaft without being able to rotate relative to the shaft, said ring-shaped element having an external diameter which matches the internal diameter of the tubular body, the length of the perimeter of the ring-shaped element having a threaded zone designed to connect with a corresponding threaded portion of the internal surface of the tubular body so that the rotation of the tubular body causes a corresponding translation of the support and connecting part along the axis of the shaft; the threaded zone and threaded portion having threading with a pitch equal to or greater than the diameter of the wire of the spring driving element.

7. The roller as described in claim 6, wherein the spring driving element consists of two helical springs, said springs being coaxial, fitted one inside the other, the ends of each of the springs being connected to respective surfaces of the support and connecting parts.

8. The roller as described in claim 7, wherein the spring driving element consists of three helical springs, said springs being coaxial, fitted one inside the other, the ends of each of the springs being connected to respective surfaces of the support and connecting parts.

9. An industrial machine tool having a mobile part movable along slideways between two extreme ends, and having a cover for covering at least the slideways, the cover comprising:

a flexible element having greater length than width;

a tubular element, supported by rotary bearings, and coaxially containing a shaft having first and second opposed ends, with the rotary bearings situated at the opposed ends of the shaft, the tubular element being supported by the rotary bearings;

means for preventing any substantial axial sliding between the tubular element and the shaft;

said cover being fixed at one end to the tubular element and at the other end to the mobile part of the machine;

a first support, coupled to the shaft in such a way to rotate with the shaft, the first support being provided with a first seat;

a second support, coupled to the tubular element in such a way to rotate with the tubular element, the second support being provided with a second seat; and at least one helical torsion spring, the spring having first and second ends, the ends of the spring being respectively fixed to first and second seats, and at least one of the first or second seats being longitudinally movable in respect to the shaft or with respect to the tubular element to which it is coupled, whereby the spring is free to vary its axial length according to the rotations of the tubular element.

10. The cover as recited in claim 9 wherein the first support is fixed to the shaft and the second support can slide longitudinally in respect to the tubular element by means of a splined coupling.

11. The cover as recited in claim 9 wherein the first support can slide longitudinally with respect to the shaft by means of a splined coupling and the second support is fixed to the tubular element.

12. The cover as recited in claim 9 further comprising a plurality of helical torsion springs, coaxially nested.

13. The cover as recited in claim 12 wherein the springs have coils and the first and second seats each have at least a cylindrical surface provided with a groove shaped as a thread, the coils of the spring on each end being threaded thereto, whereby the thread and the coils are solidly connected to give stability between the spring and the supports.

14. A cover for covering at least a slideway along which a mobile part of an industrial machine moves back and forth between two extreme ends, said cover comprising:

a flexible retractable covering part having a first and a second end, the covering part being positioned over the slideway and fixed at the first end to the mobile part of the machine;

retracting means fixed to the second end of the covering part, for retracting the covering part such that whenever the mobile part of the machine is moving the covering part is retracted, the retracting means comprising:

a support shaft having first and second opposed ends;

two rotary bearings situated at the opposed ends of the shaft;

an external tubular element, supported by the rotary bearings, and coaxially containing the shaft, the tubular element being rotatable with respect to the shaft by virtue of being supported by the rotary bearings;

means for preventing any substantial axial sliding between the tubular element and the shaft;

a first support, coupled to the shaft in such a way to rotate with the shaft, the first support being provided with a first seat;

a second support, coupled to the tubular element in such a way to rotate with the tubular element, the second support being provided with a second seat; and at least one helical torsion spring, the spring having first and second ends, the ends of the spring being respectively fixed to first and second seats, and at least one of the first or second seats being longitudinally movable in respect to the shaft or to the tubular element to which it is coupled, whereby the spring is free to vary its axial length according to the rotations of the tubular element.

* * * * *